US009993847B2

(12) United States Patent
Eriksson

(10) Patent No.: US 9,993,847 B2
(45) Date of Patent: Jun. 12, 2018

(54) CLEANING ARRANGEMENT FOR A NOZZLE OF A VACUUM CLEANER

(75) Inventor: Henrik Eriksson, Stockholm (SE)

(73) Assignee: Aktiebolaget Electrolux (SE)

( * ) Notice: Subject to any disclaimer, the term of this patent is extended or adjusted under 35 U.S.C. 154(b) by 812 days.

(21) Appl. No.: 14/374,119

(22) PCT Filed: Feb. 2, 2012

(86) PCT No.: PCT/EP2012/051773

§ 371 (c)(1),
(2), (4) Date: Aug. 25, 2014

(87) PCT Pub. No.: WO2013/113395

PCT Pub. Date: Aug. 8, 2013

(65) Prior Publication Data

US 2014/0366300 A1 Dec. 18, 2014

(51) Int. Cl.

| | |
|---|---|
| ***B08B 1/00*** | (2006.01) |
| ***A46B 17/06*** | (2006.01) |
| ***A47L 9/00*** | (2006.01) |
| ***A47L 9/28*** | (2006.01) |
| ***A47L 5/38*** | (2006.01) |
| ***A47L 7/00*** | (2006.01) |
| ***B08B 1/04*** | (2006.01) |
| ***B08B 5/04*** | (2006.01) |
| ***A47L 9/04*** | (2006.01) |

(52) U.S. Cl.

CPC ..... *B08B 1/001* (2013.01); *A46B 17/06* (2013.01); *A47L 5/38* (2013.01); *A47L 7/0057* (2013.01); *A47L 9/00* (2013.01); *A47L 9/0477* (2013.01); *B08B 1/04* (2013.01); *B08B 5/046* (2013.01); *B08B 1/002* (2013.01)

(58) Field of Classification Search

CPC ..... B08B 1/001; B08B 1/04; B08B 5/046; B08B 1/002; B08B 1/00; B08B 5/04; A47L 9/00; A47L 9/0477; A47L 5/38; A47L 7/0057; A47L 9/28; A47L 7/00; A46B 17/06

USPC ..... 15/308, 23, 38, DIG. 1

See application file for complete search history.

(56) References Cited

U.S. PATENT DOCUMENTS

| | | | |
|---|---|---|---|
| 804,213 | A | 11/1905 | Chaplin |
| 969,441 | A | 9/1910 | Backer |
| 1,231,077 | A | 6/1917 | Sheffler |
| 1,268,963 | A | 6/1918 | Gray |
| 1,412,420 | A | 4/1922 | Polansky |

(Continued)

FOREIGN PATENT DOCUMENTS

| | | |
|---|---|---|
| CA | 2466000 | 5/2003 |
| CN | 1457742 | 11/2003 |

(Continued)

OTHER PUBLICATIONS

International Search Report for International Application No. PCT/EP2012/076620 dated Jul. 23, 2013.

(Continued)

*Primary Examiner* — David Redding
(74) *Attorney, Agent, or Firm* — RatnerPrestia

(57) ABSTRACT

The present invention relates to a cleaning arrangement for a nozzle of a vacuum cleaner. The cleaning arrangement comprises a socket for receiving the vacuum cleaner nozzle and a cleaning member arranged in the socket for removing articles entangled to a rotatable member of the vacuum cleaner nozzle during rotation of the rotatable member.

17 Claims, 7 Drawing Sheets

(56) References Cited

U.S. PATENT DOCUMENTS

| | | | |
|---|---|---|---|
| 1,757,461 | A | 5/1930 | Losey |
| 1,813,325 | A | 7/1931 | Smith |
| 1,820,350 | A | 8/1931 | Dance |
| 1,907,692 | A | 5/1933 | White |
| 1,965,614 | A | 7/1934 | Sellers |
| 1,999,696 | A | 4/1935 | Kitto |
| 2,032,345 | A | 3/1936 | Cranon |
| 2,625,698 | A | 1/1953 | De Kadt et al. |
| 2,642,601 | A | 6/1953 | Saffioti |
| 2,642,617 | A | 6/1953 | Lilly |
| 2,663,045 | A | 12/1953 | Conway |
| 2,733,000 | A | 1/1956 | Sparklin |
| 2,741,785 | A | 4/1956 | Seibert |
| 2,789,306 | A | 4/1957 | Kath |
| 2,904,818 | A | 9/1959 | Sheahan |
| 2,960,714 | A | 11/1960 | Senné |
| 2,975,450 | A | 3/1961 | Williams |
| 3,268,936 | A | 8/1966 | Fukuba |
| 3,470,575 | A | 10/1969 | Larson |
| 3,536,977 | A | 10/1970 | Porter |
| 3,683,444 | A | 8/1972 | Schaeffer et al. |
| 3,722,018 | A | 3/1973 | Fisher |
| 3,862,467 | A | 1/1975 | Krickovich |
| 3,863,285 | A | 2/1975 | Hukuba |
| 3,928,884 | A | 12/1975 | Sutter |
| 4,020,526 | A | 5/1977 | Johansson |
| 4,084,283 | A | 4/1978 | Rosendall |
| 4,171,554 | A | 10/1979 | Tschudy |
| 4,173,054 | A | 11/1979 | Ando |
| 4,193,710 | A | 3/1980 | Pietrowski |
| 4,209,872 | A | 7/1980 | Maier |
| 4,317,253 | A | 3/1982 | Gut et al. |
| 4,352,221 | A | 10/1982 | Revells et al. |
| 4,370,690 | A | 1/1983 | Baker |
| 4,370,777 | A | 2/1983 | Woerwag |
| 4,372,004 | A | 2/1983 | Vermillion |
| 4,373,228 | A | 2/1983 | Dyson |
| 4,398,231 | A | 8/1983 | Currence |
| 4,426,751 | A | 1/1984 | Nordeen |
| 4,573,235 | A | 3/1986 | Baird et al. |
| 4,654,924 | A | 4/1987 | Getz et al. |
| 4,702,122 | A | 10/1987 | Richard |
| 4,802,254 | A | 2/1989 | Lahndorff et al. |
| 4,847,944 | A | 7/1989 | Lackner |
| 4,875,246 | A | 10/1989 | MacGregor |
| 4,920,605 | A | 5/1990 | Takashima |
| 4,953,253 | A | 9/1990 | Fukuda |
| 4,989,293 | A | 2/1991 | Bashyam et al. |
| 5,075,922 | A | 12/1991 | Tsuchida et al. |
| 5,115,538 | A | 5/1992 | Cochran et al. |
| 5,121,592 | A | 6/1992 | Jertson |
| 5,203,047 | A | 4/1993 | Lynn |
| 5,243,732 | A | 9/1993 | Koharagi et al. |
| 5,287,581 | A | 2/1994 | Lo |
| 5,394,588 | A | 3/1995 | Kweon et al. |
| 5,452,490 | A | 9/1995 | Brundula et al. |
| 5,482,562 | A | 1/1996 | Abernathy |
| 5,657,503 | A | 8/1997 | Caruso |
| 5,657,504 | A | 8/1997 | Khoury |
| 5,698,957 | A | 12/1997 | Sowada |
| 5,974,975 | A | 11/1999 | Seefried |
| 6,042,656 | A | 3/2000 | Knutson |
| 6,123,779 | A | 9/2000 | Conrad |
| 6,131,238 | A | 10/2000 | Weber et al. |
| 6,170,119 | B1 | 1/2001 | Conrad et al. |
| 6,253,414 | B1 | 7/2001 | Bradd et al. |
| 6,266,838 | B1 | 7/2001 | Caruso |
| 6,282,749 | B1 | 9/2001 | Tajima |
| 6,286,180 | B1 | 9/2001 | Kasper et al. |
| 6,289,552 | B1 | 9/2001 | McCormick |
| 6,351,872 | B1 | 3/2002 | McCormick |
| 6,367,120 | B2 | 4/2002 | Beauchamp |
| 6,502,277 | B1 | 1/2003 | Petersson et al. |
| 6,539,575 | B1 | 4/2003 | Cohen |
| 6,539,577 | B1 | 4/2003 | Okuda et al. |
| 6,605,156 | B1 | 8/2003 | Clark |
| 6,810,559 | B2 | 11/2004 | Mertes et al. |
| 6,883,201 | B2 | 4/2005 | Jones et al. |
| 6,892,420 | B1 | 5/2005 | Hann et al. |
| 7,143,461 | B2 | 12/2006 | Spooner |
| 7,159,276 | B2 | 1/2007 | Omoto et al. |
| 7,163,568 | B2 | 1/2007 | Sepke et al. |
| 7,171,723 | B2 | 2/2007 | Kobayashi et al. |
| 7,228,593 | B2 | 6/2007 | Conrad |
| 7,237,298 | B2 | 7/2007 | Reindle et al. |
| 7,243,393 | B2 | 7/2007 | Matusz |
| 7,293,326 | B2 | 11/2007 | Hawkins et al. |
| 7,627,927 | B2 | 12/2009 | Blocker |
| 7,631,392 | B1 | 12/2009 | Meitz |
| 7,731,618 | B2 | 6/2010 | Burlington et al. |
| 8,087,117 | B2 | 1/2012 | Kapoor et al. |
| 8,418,303 | B2 | 4/2013 | Kapoor et al. |
| 8,567,009 | B2 | 10/2013 | Krebs |
| 8,601,643 | B2 | 12/2013 | Eriksson |
| 8,671,515 | B2 | 3/2014 | Eriksson |
| 9,072,416 | B2 | 7/2015 | Kowalski |
| 9,186,030 | B2 | 11/2015 | Jung |
| 9,314,140 | B2 | 4/2016 | Eriksson |
| 2002/0007528 | A1 | 1/2002 | Beauchamp |
| 2004/0172769 | A1 | 9/2004 | Giddings |
| 2004/0181888 | A1 | 9/2004 | Tawara |
| 2004/0244140 | A1 | 12/2004 | Joo |
| 2005/0015916 | A1 | 1/2005 | Orubor |
| 2005/0015922 | A1 | 1/2005 | Lim et al. |
| 2005/0091788 | A1 | 5/2005 | Forsberg et al. |
| 2006/0000053 | A1 | 1/2006 | Lim |
| 2006/0037170 | A1 | 2/2006 | Shimizu |
| 2006/0162121 | A1 | 7/2006 | Naito et al. |
| 2006/0272122 | A1 | 12/2006 | Butler et al. |
| 2006/0288517 | A1 | 12/2006 | Oh |
| 2007/0079474 | A1 | 4/2007 | Min |
| 2008/0052846 | A1 | 3/2008 | Kapoor |
| 2008/0289141 | A1 | 11/2008 | Oh |
| 2009/0000057 | A1 | 1/2009 | Yoo |
| 2009/0100636 | A1 | 4/2009 | Sohn |
| 2009/0229075 | A1 | 9/2009 | Eriksson |
| 2010/0107359 | A1 | 5/2010 | Yoo |
| 2010/0205768 | A1 | 8/2010 | Oh |
| 2010/0287717 | A1 | 11/2010 | Jang |
| 2010/0312912 | A1 | 12/2010 | Han et al. |
| 2010/0313912 | A1 | 12/2010 | Han |
| 2011/0035900 | A1 | 2/2011 | Chae |
| 2012/0013907 | A1 | 1/2012 | Jung |
| 2012/0124769 | A1 | 5/2012 | Krebs |
| 2013/0007982 | A1 | 1/2013 | Yun |
| 2013/0008469 | A1 | 1/2013 | Yun |
| 2013/0042429 | A1 | 2/2013 | Misumi |
| 2013/0055522 | A1 | 3/2013 | Hawkins |
| 2013/0192021 | A1 | 8/2013 | Eriksson |
| 2013/0192022 | A1 | 8/2013 | Eriksson |
| 2013/0192023 | A1 | 8/2013 | Eriksson |
| 2013/0192024 | A1 | 8/2013 | Eriksson |
| 2013/0198995 | A1 | 8/2013 | Eriksson |
| 2014/0259521 | A1 | 9/2014 | Kowalski |
| 2014/0304941 | A1 | 10/2014 | Eriksson |
| 2014/0331446 | A1 | 11/2014 | Eriksson |
| 2014/0352104 | A1 | 12/2014 | Eriksson |
| 2014/0359968 | A1 | 12/2014 | Eriksson |
| 2016/0015233 | A1 | 1/2016 | Uphoff |

FOREIGN PATENT DOCUMENTS

| | | |
|---|---|---|
| CN | 1593320 | 3/2005 |
| CN | 2746989 | 12/2005 |
| CN | 1816300 | 8/2006 |
| CN | 1816301 | 9/2006 |
| CN | 1883354 | 12/2006 |
| CN | 101310666 | 11/2008 |
| CN | 101686783 | 3/2010 |
| CN | 101984742 | 3/2011 |
| CN | 102334943 | 2/2012 |
| CN | 102462450 | 5/2012 |
| DE | 102010017211 | 12/2011 |
| DE | 102010017258 | 12/2011 |

(56) References Cited

FOREIGN PATENT DOCUMENTS

| | | | |
|---|---|---|---|
| EP | 0 649 625 | | 9/1994 |
| EP | 1 415 583 | | 5/2004 |
| EP | 1442693 | | 8/2004 |
| EP | 1 642 520 | | 4/2006 |
| EP | 1 994 869 | | 11/2008 |
| EP | 2253258 | | 11/2010 |
| EP | 2273906 | | 1/2011 |
| EP | 2543301 | | 1/2013 |
| FR | 1068296 | | 6/1954 |
| FR | 2855742 | | 12/2004 |
| GB | 2 000 963 | | 6/1978 |
| GB | 2 231 778 | | 11/1990 |
| JP | 4944560 | | 4/1974 |
| JP | 50114057 | | 9/1975 |
| JP | 61062426 | | 3/1986 |
| JP | 05095868 | | 4/1993 |
| JP | 05103740 | | 4/1993 |
| JP | 405095868 | | 4/1993 |
| JP | 405305044 | | 11/1993 |
| JP | 06-086743 | | 3/1994 |
| JP | 0686743 | | 3/1994 |
| JP | 0856877 | | 3/1996 |
| JP | 08056877 | | 3/1996 |
| JP | 08289862 | | 11/1996 |
| JP | 11313786 | A | 11/1999 |
| JP | 2002165731 | | 6/2002 |
| JP | 2003047577 | | 2/2003 |
| JP | 2003125991 | | 5/2003 |
| JP | 2003164399 | A | 6/2003 |
| JP | 2004159961 | A | 6/2004 |
| JP | 2005160578 | | 6/2005 |
| JP | 2005211426 | | 8/2005 |
| JP | 2008000382 | | 1/2008 |
| JP | 2008188319 | | 8/2008 |
| JP | 2008278947 | | 11/2008 |
| JP | 2009022644 | A | 2/2009 |
| WO | WO 92/10967 | | 7/1992 |
| WO | 2008099583 | | 8/2008 |
| WO | 2009117383 | | 9/2009 |
| WO | WO 2009/117383 | | 9/2009 |
| WO | 2010041184 | | 4/2010 |
| WO | 2013060365 | | 5/2013 |
| WO | 2013060879 | | 5/2013 |
| WO | 2013060880 | | 5/2013 |
| WO | 2014094869 | | 6/2014 |
| WO | 2014177216 | | 11/2014 |

OTHER PUBLICATIONS

Non-Final Office Action dated Apr. 16, 2015 for U.S. Appl. No. 14/354,460.
Notice of Allowance dated Apr. 24, 2015 for U.S. Appl. No. 13/838,035.
Entire patent prosecution history of U.S. Appl. No. 14/702,034, filed, May 1, 2015, entitled, "Cleaning Nozzle for a Vacuum Cleaner."
Notice of Allowance dated Jun. 24, 2015 for U.S. Appl. No. 13/826,855.
Office Action dated Jul. 7, 2015 for U.S. Appl. No. 13/826,934.
Chinese Office Action dated Jul. 1, 2015 for Chinese Application No. 201310485330.X, including English language translation.
Chinese Office Action dated Jul. 14, 2015 for Chinese Application No. 201310479507.5, including English language translation.
Chinese Office Action dated Jul. 3, 2015 for Chinese Application No. 201310485943.3, including English language translation.
Chinese Office Action dated Jun. 30, 2015 for Chinese Application No. 201310485447.8, including English language translation.
International Preliminary Report on Patentability for International Application No. PCT/IB2014/001050 dated Sep. 15, 2015.
International Preliminary Report on Patentability for International Application No. PCT/IB2014/001256 dated Sep. 15, 2015.
Notice of Allowance dated Sep. 10, 2015 for U.S. Appl. No. 13/826,630.
Notice of Allowance dated Oct. 9, 2015 for U.S. Appl. No. 14/354,460.
Notice of Allowance dated Oct. 16, 2015 for U.S. Appl. No. 13/835,691.
Entire patent prosecution history of U.S. Appl. No. 14/651,059, filed Jun. 10, 2015, entitled, "Cleaning Arrangement for a Rotatable Member of a Vacuum Cleaner, Cleaner Nozzle, Vacuum Cleaner and Cleaning Unit."
Office Action dated May 20, 2015 for U.S. Appl. No. 13/835,691.
Entire patent prosecution history of U.S. Appl. No. 14/730,833, filed Jun. 4, 2015, entitled, "Vacuum Cleaner Agitator Cleaner With Agitator Lifting Mechanism."
International Search Report and Written Opinion for International Application No. PCT/IB2015/001873, dated Feb. 4, 2016.
Notice of Allowance dated Feb. 11, 2016 for U.S. Appl. No. 13/826,934.
Japanese Office Action dated Dec. 15, 2015 for Japanese Application No. 2014-555092 with translation.
Chinese Office Action dated Nov. 27, 2015 for Chinese Application No. 201280068532.8 with translation.
Chinese Office Action dated Feb. 29, 2016 for Chinese Application No. 201310485330.X with translation. (pp. 1-9).
Non Final Office Action for U.S. Appl. No. 14/730,833, dated May 19, 2016. (pp. 1-31).
Chinese Office Action dated Apr. 1, 2016 for Chinese Application No. 201280076273.3 with translation. (pp. 1-17).
Chinese Office Action for Chinese Application No. 201310485447.8, dated Feb. 14, 2015 with translation. (pp. 1-5).
Non Final Office Action for U.S. Appl. No. 14/354,466, dated Jan. 27, 2017, 10 pages.
Non Final Office Action for U.S. Appl. No. 14/467,697, dated Feb. 13, 2017, 17 pages.
Non Final Office Action for U.S. Appl. No. 14/462,956, dated Feb. 22, 2017, 13 pages.
Notice of Allowance for U.S. Appl. No. 14/354,449, dated Nov. 30, 2016, 10 pages.
Non Final Office Action for U.S. Appl. No. 14/888,275, dated Dec. 2, 2016, 24 pages.
Notice of Allowance for U.S. Appl. No. 14/730,833, dated Dec. 2, 2016, 14 pages.
Japanese Office Action for Japanese Application No. 2015548227, dated Oct. 14, 2016, 5 pages.
Chinese Office Action for Application No. 201280058003.X, dated Oct. 9, 2016, 18 pages.
Notice of Allowance dated Dec. 23, 2015 for U.S. Appl. No. 14/354,460.
Notice of Allowance dated Dec. 31, 2015 for U.S. Appl. No. 13/826,630.
Notice of Allowance dated Dec. 15, 2015 for U.S. Appl. No. 13/835,691.
Final Office Action dated Nov. 30, 2015 for U.S. Appl. No. 13/826,934.
International Search Report dated Dec. 10, 2013 for International Application No. PCT/EP2013/059148.
Non Final Office Action for U.S. Appl. No. 14/354,449, dated Aug. 11, 2016, 45 pages.
Japanese Office Action for Japanese Application No. 2014-537645, dated Jun. 14, 2016 with translation, 5 pages.
Japanese Office Action for Japanese Application No. 2014-555092, dated May 24, 2016 with translation, 5 pages.
International Preliminary Report on Patentability for International Application No. PCT/IB2015/001873, dated Feb. 28, 2017, 3 pages.
Entire patent prosecution history of U.S. Appl. No. 12/405,761, filed Mar. 17, 2009, entitled, "Agitator With Cleaning Features," now U.S. Pat. No. 8,601,643, issued Dec. 10, 2013.
Entire patent prosecution history of U.S. Appl. No. 13/826,400, filed Mar. 14, 2013, entitled, "Brushroll Cleaning Feature With Resilient Linkage to Regulate User-Applied Force," now U.S. Pat. No. 8,671,515, issued Mar. 18, 2014.
Entire patent prosecution history of U.S. Appl. No. 13/826,630, filed Mar. 14, 2013, entitled, "Brushroll Cleaning Feature With Spaced Brushes and Friction Surfaces to Prevent Contact."

(56) References Cited

OTHER PUBLICATIONS

Entire patent prosecution history of U.S. Appl. No. 13/826,855, filed Mar. 14, 2013, entitled, "Brushroll Cleaning Feature With Overload Protection During Cleaning."
Entire patent prosecution history of U.S. Appl. No. 13/826,934, filed Mar. 14, 2013, entitled, "Automated Brushroll Cleaning."
Entire patent prosecution history of U.S. Appl. No. 13/835,691, filed Mar. 15, 2013, entitled, "Vacuum Cleaner Agitator Cleaner With Power Control."
Entire patent prosecution history of U.S. Appl. No. 13/838,035, filed Mar. 15, 2013, entitled, "Vacuum Cleaner Agitator Cleaner With Brushroll Lifting Mechanism."
Entire patent prosecution history of U.S. Appl. No. 14/354,449, filed Apr. 25, 2014, entitled, "Cleaning Nozzle for a Vacuum Cleaner."
Entire patent prosecution history of U.S. Appl. No. 14/354,460, filed Jun. 19, 2014, entitled, "Cleaning Nozzle for a Vacuum Cleaner."
Entire patent prosecution history of U.S. Appl. No. 14/354,466, filed Apr. 25, 2014, entitled, "Cleaning Nozzle for a Vacuum Cleaner."
Entire patent prosecution history of U.S. Appl. No. 14/462,956, filed Aug. 19, 2014, entitled, "Vacuum Cleaner Brushroll Cleaner Configuration."
Entire patent prosecution history of U.S. Appl. No. 14/467,697, filed Aug. 25, 2014, entitled, "Actuator Mechanism for a Brushroll Cleaner."
International Search Report and Written Opinion for International Application No. PCT/IB2014/001050, dated Oct. 28, 2014.
International Search Report and Written Opinion for International Application No. PCT/IB2014/001256, dated Oct. 28, 2014.
Non Final Office Action for U.S. Appl. No. 14/702,034, dated Oct. 16, 2017, 12 pages.
Chinese Office Action for Application No. 201280058003.X, dated Apr. 6, 2017 with translation, 17 pages.
Final Office Action for U.S. Appl. No. 14/354,466, dated May 12, 2017, 13 pages.
Korean Office Action for Korean Application No. 10-2014-7013892, dated Jun. 30, 2017 with translation, 16 pages.
Notice of Allowance for U.S. Appl. No. 14/354,449, dated Aug. 11, 2017, 9 pages.
Notice of Allowance for U.S. Appl. No. 14/354,466, dated Aug. 1, 2017, 8 pages.
Notice of Allowance for U.S. Appl. No. 14/462,956, dated Jul. 19, 2017, 10 pages.
Notice of Allowance for U.S. Appl. No. 14/467,697, dated Jun. 30, 2017, 11 pages.
Non Final Office Action for U.S. Appl. No. 14/651,059, dated Jul. 17, 2017, 8 pages.
Search Report and Written Opinion for PCT International Application No. PCT/US2009/037348 dated May 14, 2009.
International Search Report for PCT International Application No. PCT/EP2011/068743 dated Jun. 14, 2012.
International Search Report for PCT International Application No. PCT/EP2012/071318 dated Jan. 1, 2013.
International Search Report for PCT International Application No. PCT/EP2012/071319 dated Dec. 11, 2012.
International Search Report for PCT International Application No. PCT/EP2012/051773 dated Sep. 17, 2012.
Supplemental European Search Report for International Application No. EP09721677 dated Oct. 30, 2012.
Office Action (with English translation) for Chinese Patent Application No. 200980110915.5 dated Feb. 4, 2013.
Notice of Allowance for U.S. Appl. No. 14/651,059, dated Mar. 27, 2018, 8 pages. 8.
Final Office Action for U.S. Appl. No. 14/702,034, dated Apr. 4, 2018, 7 pages.
Notification of Reasons for Refusal for Japanese Application No. 2015-562412, dated Mar. 14, 2018 with translation, 4 pages.

CLEANING ARRANGEMENT FOR A NOZZLE OF A VACUUM CLEANER

This application is a National Stage Application of International Application No. PCT/EP2012/051773, filed Feb. 2, 2012, the entire disclosure of which is expressly incorporated by reference herein.

TECHNICAL FIELD

The invention relates to a cleaning arrangement for a nozzle of a vacuum cleaner.

BACKGROUND

In vacuum cleaning nozzles provided with a rotatable member, i.e. a rotatable brush roll, it is known that threads, lint, human or animal hairs or any other fibrous material tend to cling or wrap around, or adhere, to the brush roll during operation of the vacuum cleaner. This may impair the functioning of the cleaning nozzle.

In international patent application having publication number WO2009/117383A2, it is disclosed a cleaning nozzle for a vacuum cleaner provided with a rotary brush having projecting friction surfaces and one or more cleaning members for removing debris that has been wrapped around the rotary brush. The cleaning members are positioned adjacent the rotary brush and are adapted to move between a resting position and a cleaning position, and are arranged to clean the rotary brush during rotation of the brush. Debris that has been collected on a rotary brush is often difficult to remove because it has wrapped tightly around the brush roll and intertwined the bristles. Therefore, a significant force is needed to be able to thread off the entangled threads by means of a cleaning member pressing against a friction member. Such a force may be applied manually by a user of the vacuum cleaner. The electrical vacuum cleaner or motor brush head need to be capable of providing the necessary power to obtain rotation of the brush roll when such force is applied.

A drawback with this solution is that the construction of the nozzle becomes relatively complex with the addition of the cleaning member and various mechanical components associated therewith for moving the cleaning member between its two positions. Moreover, for a batter-driven vacuum cleaner, the force applied by the cleaning member for cleaning the brush roll will accelerate discharge of the battery. Further, this solution requires additional space in the nozzle, since the space must be shared with existing components such as the rotary brush.

SUMMARY

An object of the present invention is to overcome or at least mitigate the above mentioned drawbacks.

This object is attained according to an aspect of the present invention by a cleaning arrangement for a nozzle of a vacuum cleaner. The cleaning arrangement comprises a socket for receiving the vacuum cleaner nozzle and at least one cleaning member arranged in the socket for removing articles entangled to a rotatable member of the vacuum cleaner nozzle during rotation of the rotatable member.

Thus, the nozzle of the vacuum cleaner is positioned in the socket of the cleaning arrangement of the present invention, wherein the nozzle rotatable member embodied in the form of a brush roll arranged around a longitudinal axis of the nozzle and employed for picking up particles from a surface to be cleaned cooperates with a correspondingly longitudinally extending cleaning member of the socket when the rotatable member is set to rotate by having a user operating the vacuum cleaner to start the rotation, or by having the rotation start automatically when the arrangement receives the vacuum cleaner. Hence, the cleaning member will cooperate with the rotating brush roll of the vacuum cleaner to remove articles such as threads, lint, human or animal hairs or any other fibrous material which wraps around or adheres to the brush roll. To this end, the cleaning member is arranged to be positioned on a small distance from, or even in contact with, the rotating brush roll when the articles are to be removed. Advantageously, the debris is removed from the brush roll without having the user going through the tedious and awkward process of removing it manually. Further advantageous is that the cleaning arrangement of the present invention is arranged externally from the nozzle and thus no longer contained in the nozzle itself.

In an embodiment of the present invention, the cleaning arrangement is arranged in a charging stand for charging the vacuum cleaner. Thus, the vacuum cleaner nozzle is positioned in the socket of the charging stand whereupon the brush roll is set to rotate to commence cleaning thereof while the battery of vacuum cleaner simultaneous is charged.

This embodiment further has the advantage that the vacuum cleaner will have access to required operating power for rotating the brush roll when cleaning of the brush roll is to be undertaken.

In an alternative embodiment of the present invention, the cleaning arrangement is arranged to be hand-held. By providing a hand-held and portable cleaning arrangement, a user can advantageously move the arrangement around his/her house and clean the vacuum cleaner brush roll without having to position the vacuum cleaner in its charging stand. Such cleaning arrangement could further be used with vacuum cleaners which are not battery-driven and hence do not have an associated charging stand.

In a further embodiment of the present invention, the cleaning member comprises a resilient sheet member capable of providing a resilient contact with the rotatable member of the vacuum cleaner nozzle. Advantageously, by providing resilient contact for a cleaning action, the power required by the vacuum cleaner to obtain rotation of the rotatable member is less as compared to a rigid, non-resilient cleaning member. A further advantage is that wear of the rotatable member caused by the cleaning member decreases.

In yet another embodiment of the present invention, the cleaning member comprises a longitudinal bar holding the resilient sheet member, the longitudinal bar being arranged to extend longitudinally in the socket, and thus correspondingly along the longitudinal axis of the rotatable member of the vacuum cleaner nozzle positioned in the socket of the cleaning arrangement. Advantageously, the longitudinal bar lends stability to the resilient sheet member, thus increasing stability of the cleaning member.

In yet another embodiment, the cleaning arrangement further comprising a pivot mechanism arranged to pivotally move the cleaning member between a resting position in which the cleaning member is lowered into the socket and a cleaning position in which the cleaning member is raised from the socket to cooperate with the rotatable member of the vacuum cleaner to remove the entangled articles. Advantageously, the pivot mechanism enable the cleaning member, which typically has a blade-like structure, to be hidden in the socket in order to prevent any user to hurt himself/herself on a potentially sharp cleaning blade when no nozzle is positioned in the socket.

In still another embodiment, the cleaning arrangement further comprises a lever mechanism arranged to cooperate with the pivot mechanism to pivotally move the cleaning member to its cleaning position when the weight of the vacuum cleaner acts on the lever mechanism. Thus, the vacuum cleaner is positioned in the socket of the cleaning arrangement whereby one end of the lever mechanism advantageously will be tilted in a direction towards the floor and the other will act on the pivot mechanism to move the cleaning member to its cleaning position, making the complete procedure of setting the cleaning member in its cleaning position automatic from the perspective of the user. Thereafter, the brush roll is set into rotating motion, either automatically or by user operation of the vacuum cleaner.

In an alternative embodiment, the cleaning member is arranged to be moved from the resting position to the cleaning position by applying a pressing force to a push button provided on the socket, which force subsequently will act on the pivot mechanism to pivotally move the cleaning member to its cleaning position.

It is noted that the invention relates to all possible combinations of features recited in the claims. Further features of, and advantages with, the present invention will become apparent when studying the appended claims and the following description. Those skilled in the art realize that different features of the present invention can be combined to create embodiments other than those described in the following.

BRIEF DESCRIPTION OF THE DRAWINGS

The invention is now described, by way of example, with reference to the accompanying drawings, in which.

DETAILED DESCRIPTION

Figure 1:
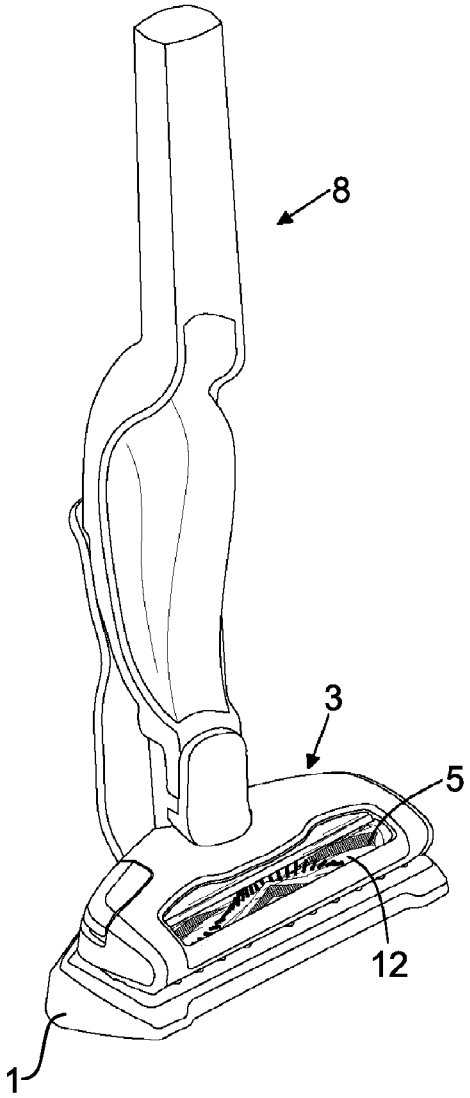
FIG. 1 shows a battery-driven vacuum cleaner of an upright model positioned in a cleaning arrangement according to an embodiment of the present invention.

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Throughout the application, the terms "rotatable member" and "brush roll" will be used interchangeably. It should further be noted that each drawing shows a cleaning arrangement comprising a single cleaning member. However, it should be noted that a cleaning member comprising more than one cleaning member can be envisaged FIG. 1 illustrates a battery-driven vacuum cleaner 8 of an upright model comprising a nozzle 3 provided with a rotatable member 5, like a brush roll, for picking up particles from a surface to be cleaned. The vacuum cleaner 8 is positioned in a charging stand 1 for charging of its battery, which charging stand 1 is supplied with a cleaning arrangement according to an embodiment of the present invention for removing articles entangled to the rotatable member 5. This cleaning arrangement will be discussed in detail in connection to describing subsequent drawings. The nozzle 3 may comprise a cover 12 that at least partly is made of transparent material such that the rotatable member 5 may be visible through the nozzle cover 12. Thereby, the user is able to see if there are plenty of articles like hair, thread or lint entangled to the rotatable member 5.

Figure 2:
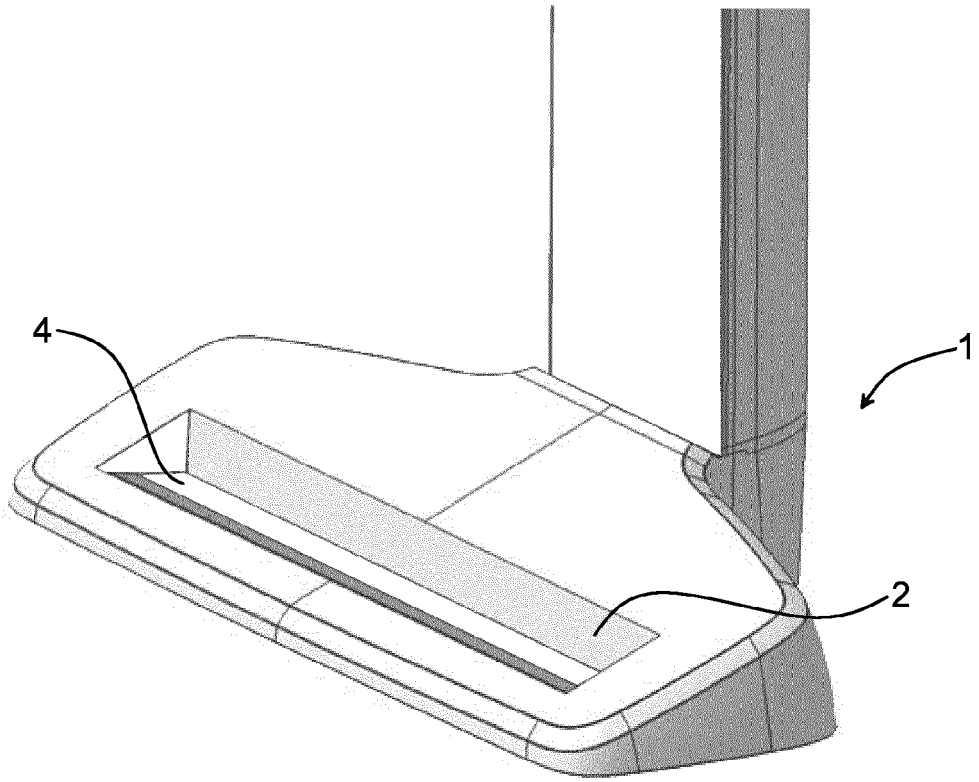
FIG. 2 shows an embodiment of a cleaning arrangement of the present invention implemented in a charging stand where a cleaning member is in its resting position.

FIG. 2 shows an embodiment of a cleaning arrangement of the present invention where the cleaning arrangement 1 is implemented in a charging stand 1 for charging a battery-driven vacuum cleaner as was discussed in connection to FIG. 1. However, it should be noted that the cleaning arrangement can be embodied in other forms, such as e.g. a portable arrangement which advantageously can be used with vacuum cleaners which are not battery-driven but connected to the mains. The cleaning arrangement comprises a socket 2 for receiving the vacuum cleaner nozzle (not shown in FIG. 2) and a cleaning member 4 arranged in the socket for removing articles entangled to a rotatable member of the vacuum cleaner nozzle during rotation of the rotatable member.

Figure 3B:
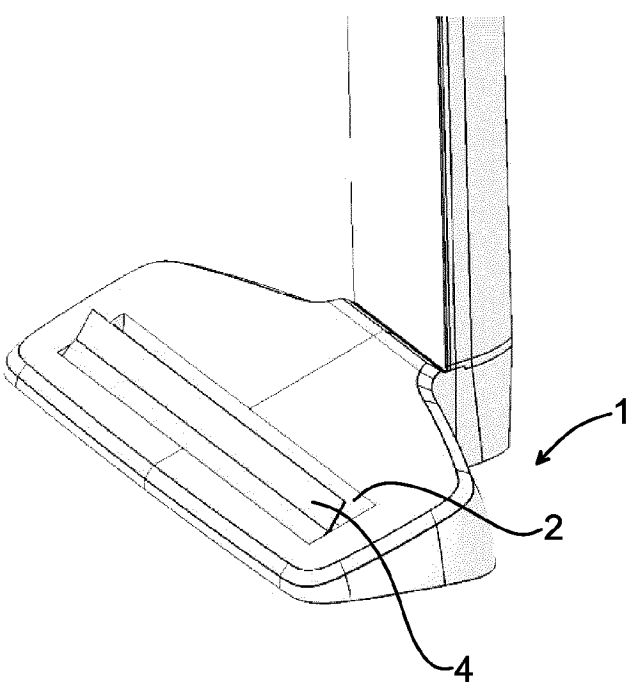
FIG. 3*b* shows the cleaning arrangement of FIG. 3*a* without having a nozzle positioned therein, wherein a cleaning member is in its cleaning position.
Figure 3A:
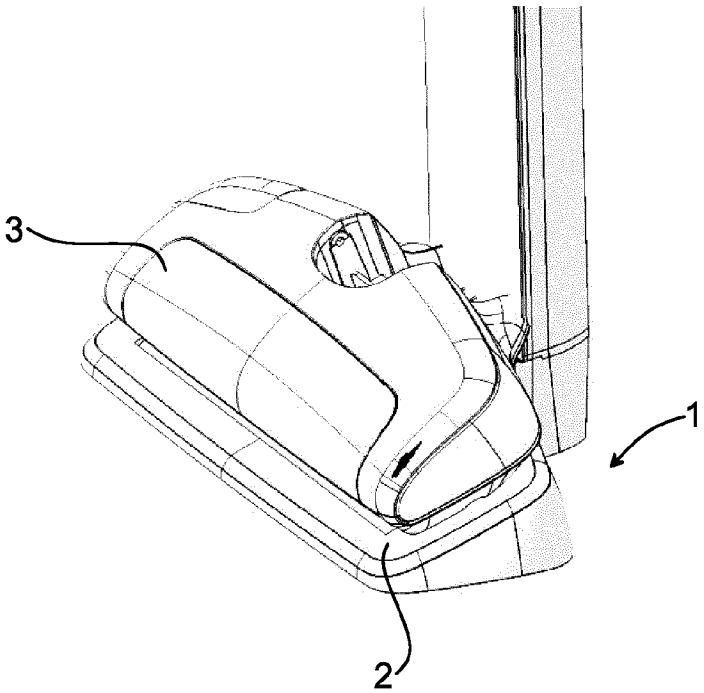
FIG. 3*a* shows a vacuum cleaner nozzle positioned in a cleaning arrangement according to an embodiment of the present invention.

With reference to FIG. 3*a*, the nozzle 3 of the vacuum cleaner (not shown in FIG. 3*a*) is positioned in the socket 2 of the charging stand 1. The nozzle is in its interior arranged with a rotatable member (which will be discussed in more detail in connection to FIG. 4) employed for picking up particles from a surface to be cleaned, which member is arranged along a longitudinal axis of the nozzle. FIG. 3*b* shows the cleaning member 4 of the cleaning arrangement implemented in the charging stand 1, which cleaning member cooperates with the rotatable member when the rotatable member is set to rotate, either automatically when the vacuum cleaner is set into contact with the cleaning arrangement or by having a user operating the vacuum cleaner to start the rotation. Hence, the cleaning member 2 will cooperate with the rotatable member, i.e. the brush roll of the vacuum cleaner, to remove articles such as threads, lint, human or animal hairs or any other fibrous material which wraps around or adheres thereto. FIG. 3*b* shows the cleaning member 4 in its cleaning position. Hence, the cleaning member is raised from the socket 2 to cooperate with the brush roll. While FIG. 2 shows the cleaning member 4 in its lowered, resting position, it is to be noted that a cleaning arrangement can be envisaged where the cleaning member always is in its raised position and thus cannot be selectively switched between a cleaning position and a resting position.

Figure 4:
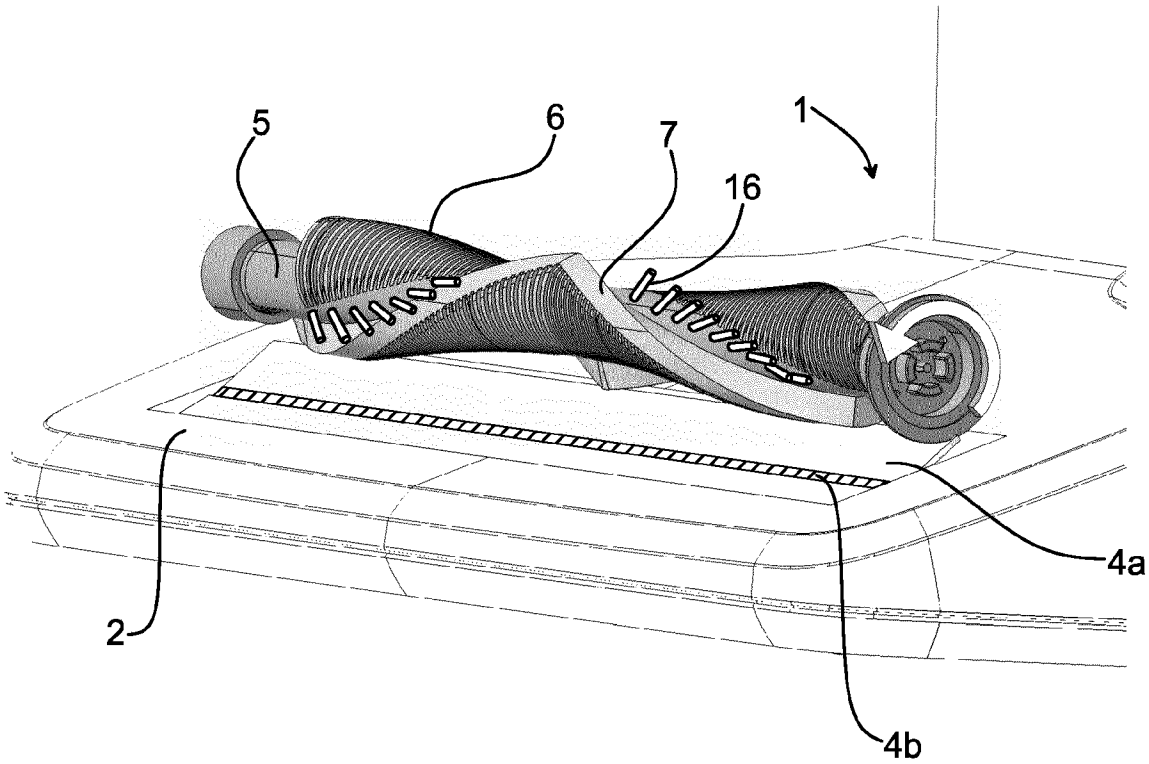
FIG. 4 shows a brush roll positioned in a cleaning arrangement according to an embodiment of the present invention.

FIG. 4 shows a brush roll 5 positioned in the socket 2 of the charging stand 1 for cleaning. It should be noted that the brush roll may be designed in many different ways to effectively pick up particles from the surface to be cleaned. Thus, the brush roll 5 of FIG. 4 is one exemplifying design out of a great number of possible designs. The brush roll comprises a support surface 7 provided on a radially projecting member 6. In the example shown, two projecting members 6 are helically arranged along a longitudinal axis of the brush roll 5. In its cleaning position, the cleaning member 4 is raised from the socket 2 and set to contact the support surface 7 of the brush roll 5. Upon rotation of the brush roll 5, the cleaning member 4 will remove the articles adhered to the brush roll 5. The cleaning member may be of a rigid material, but comprises in an embodiment of the present invention a resilient sheet member 4*a* capable of providing a resilient contact with the support surface 7 of the brush roll 5. In a further embodiment, the cleaning member 4 comprises a longitudinal bar 4*b* holding the resilient sheet member 4*a* in order to lend stability to the resilient sheet member, thus increasing stability of the cleaning member.

When in use, the cleaning arrangement works as follows. During brush roll cleaning the cleaning member 4 will interact and apply pressure on the support surface 7 provided on the rotatable brush roll 5 of the vacuum cleaner nozzle. During the cleaning process, the motor fan of the vacuum cleaner is also turned on. For the example brush roll 5 of FIG. 4, the support surface 7 is the only area of the brush roll that will be in contact with the cleaning member 4 during a cleaning process. For a full revolution of the brush roll 5, the entire support surface 7 will have been in contact with the cleaning member 4 and therefore any entangled article will be exposed to the cleaning interaction in-between these parts. Entangled articles will get torn into smaller pieces by the tearing, or friction, caused by the cleaning member 4 at the support surface 7. These torn articles may be separated from the brush roll 5 by the airflow of the vacuum cleaner in combination with centrifugal force due to the rotational movement of the brush roll 5 and will end up in the dust container or dust bag of the vacuum cleaner. The brush roll cleaning performance is dependent on the rotational speed of the brush roll; the higher speed, the faster brush roll cleaning. It should be noted that the brushes 16 of the brush roll 5 will be in contact with the cleaning member 4 during brush roll cleaning, but will bend such that they do not end up between the cleaning member 4 and the support surface 7. Thus, the brushes 16 are not subject to the degree of wear that e.g. hair entangled to the rotating brush roll 5 is.

A suitable material should preferably be chosen for the resilient sheet member 4*a*. The material will, over time, be subject to wear and lose its original tearing ability. To be wear-resistant, relatively hard spring steel may be used. The edge of the cleaning member 4 that will be in contact with the support surface 7 need to be relatively sharp in order to effectively remove entangled articles. By shearing, or punch pressing the spring steel, one of the edges of the sheared surface will be rounded while the other will have an edge burr. By punch pressing the cleaning member 4 one edge of the cut surface will be sharper than the other. By shearing, or punch pressing, there will be as mentioned above, an edge burr at the cleaning member 4 edge. If the edge burr is minimized this will create a sharp edge suited for cleaning entangled articles from the brush roll 5. As an alternative to the above mentioned edge burr, the edge of the cleaning member 4 may be sharpened by machining. Thereby, improved tolerance of the sharp edge is achieved.

Figure 5:
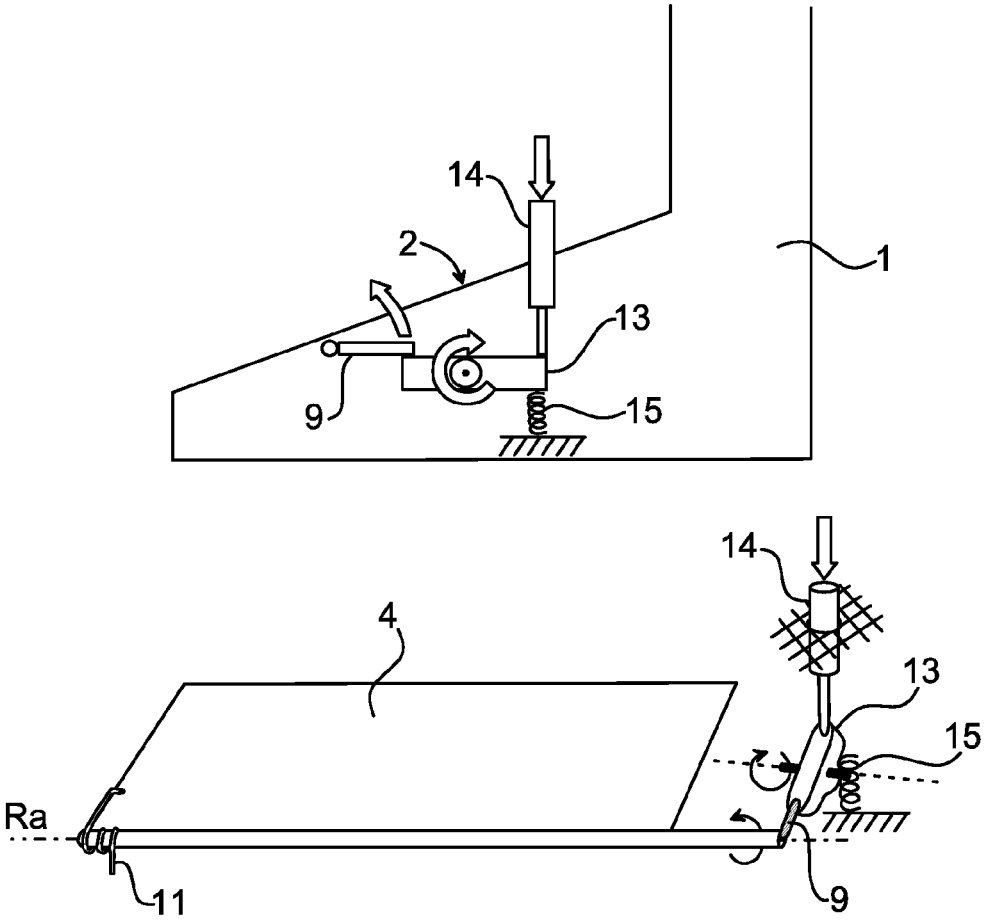
FIG. 5 shows a cleaning arrangement arranged with a pivot mechanism and a lever mechanism according to embodiments of the present invention.

FIG. 5 shows a further embodiment of the present invention, where the cleaning arrangement, again depicted implemented in a charging stand 1 even though it could be provided as a stand-alone unit, comprises a pivot mechanism 9 arranged to pivotally move the cleaning member 4 between a resting position in which the cleaning member is lowered into the socket 2 and a cleaning position in which the cleaning member is raised from the socket to cooperate with the rotatable member of the vacuum cleaner to remove the entangled articles. Advantageously, the pivot mechanism enable the cleaning member, which typically has a blade-like structure, to be hidden in the socket in order to prevent any user to hurt himself/herself on a potentially sharp cleaning blade when no nozzle is positioned in the socket. This pivot mechanism could be operated manually by an operator in that the operator with his finger flips the pivot mechanism 9 around a rotational axis $R_a$ of the cleaning member 4 to selectively set the cleaning member in its resting or cleaning position. As can be seen in FIG. 5, a first spring element 11 is arranged around the rotational axis $R_a$ of the cleaning member 4 for returning the cleaning member to its resting position when the cleaning procedure has ended.

With further reference to FIG. 5, in another embodiment of the present invention, instead of having the operator manually setting the cleaning member 4 in its cleaning position, a lever mechanism 13 is introduced to cooperate with the pivot mechanism 9 to pivotally move the cleaning member 4 to its cleaning position when the weight of the vacuum cleaner acts on the lever mechanism 13. One solution for transferring a force applied by the vacuum cleaner to the lever mechanism 13 is to have a push button 14 which the vacuum cleaner nozzle pushes down in the socket, thereby applying a force to the lever mechanism 13, which in its turn pivots around a rotational axis and further is arranged to be in contact with the pivot mechanism 9 such that it creates the pivotal movement of the cleaning member 4 to selectively set the cleaning member in its cleaning position when the vacuum cleaner is placed in the charging stand 1, and in its resting position when the vacuum cleaner is removed from the charging stand 1. Thus, the vacuum cleaner is positioned in the socket 2 of the cleaning arrangement whereby one end of the lever mechanism 13 advantageously will be tilted in a direction towards the floor by the push button 14 and the other end will act on the pivot mechanism 9 to move the cleaning member 4 to its cleaning position, making the complete procedure of setting the cleaning member in its cleaning position automatic from the perspective of the user. Thereafter, the brush roll is set into rotating motion, either automatically or by user operation of the vacuum cleaner. The cleaning arrangement can be arranged with a second spring element 15 applying a vertical force acting upwards to the lever mechanism 13 in order to have the lever mechanism revert to its position of equilibrium store when no weight is applied to the push button 14.

Figure 6A:
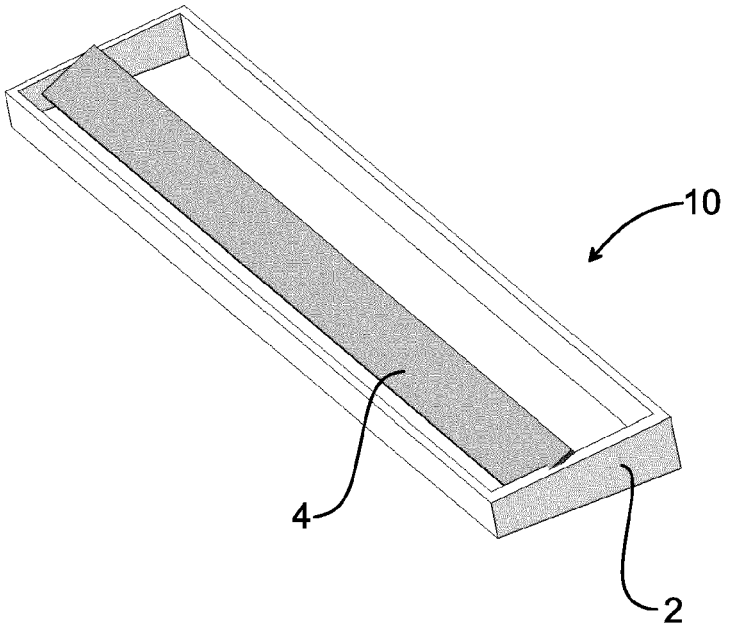
FIG. 6*a* shows a portable cleaning arrangement according to an embodiment of the present invention.
Figure 6B:
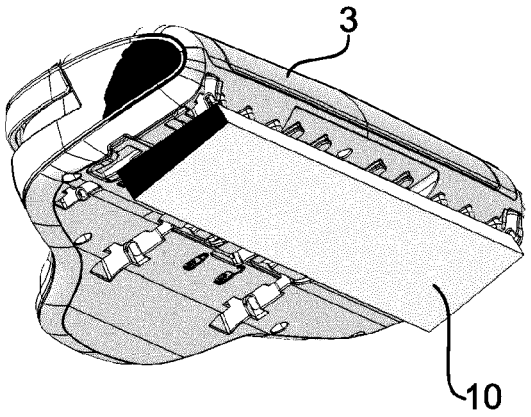
FIG. 6*b* shows the portable cleaning arrangement of FIG. 6*a* applied to a nozzle.
Figure 7:
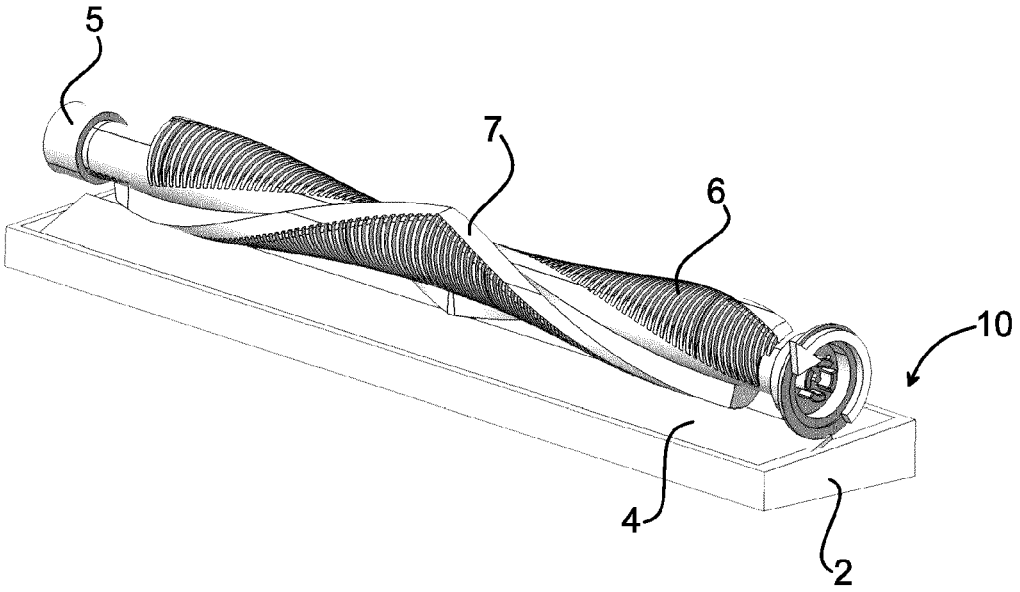
FIG. 7 shows the portable cleaning arrangement of FIG. 6*a* acting on a brush roll.

FIGS. 6*a* and *b* shows an alternative embodiment of the present invention, where the cleaning arrangement 10 is arranged to be hand-held. By providing a hand-held and portable cleaning arrangement, a user can advantageously move the arrangement around his/her house and clean the vacuum cleaner brush roll without having to position the vacuum cleaner in its charging stand. Such cleaning arrangement could further be used with vacuum cleaners which are not battery-driven and hence do not have an associated charging stand. With reference to FIG. 6*a*, the portable cleaning arrangement 10 comprises in its simplest form a socket 2 with a cleaning member 4 arranged therein. With reference to FIG. 6*b*, the cleaning arrangement 10 is applied to the nozzle 3 of the vacuum cleaner, and in the more detailed illustration shown in FIG. 7, it can be seen that the cleaning member 4 of the portable cleaning arrangement 10 is set into contact with the support surface 7 of the projecting member 6 of the brush roll 5 (shown without brushes) and cleaning of the nozzle brush roll can commence as has been described hereinabove.

Even though the invention has been described with reference to specific exemplifying embodiments thereof, many different alterations, modifications and the like will become apparent for those skilled in the art. The described embodiments are therefore not intended to limit the scope of the invention, as defined by the appended claims.

The invention claimed is:

1. A cleaning arrangement for a vacuum cleaner nozzle having a rotatable member therein, the cleaning arrangement comprising:

a socket for receiving the vacuum cleaner nozzle;

at least one cleaning member arranged in the socket for removing, during rotation of the rotatable member, articles entangled to the rotatable member;

and a pivot mechanism arranged to pivotally move the cleaning member between a resting position in which the cleaning member is lowered into the socket and a cleaning position in which the cleaning member is raised from the socket to cooperate with the rotatable member to remove the entangled articles.

2. The cleaning arrangement of claim 1, wherein the cleaning member is arranged to extend longitudinally in the socket.

3. The cleaning arrangement of claim 2, wherein the cleaning member comprises a resilient sheet member capable of providing a resilient contact with the rotatable member.

4. The cleaning arrangement of claim 3, wherein the cleaning member comprises a longitudinal bar holding the resilient sheet member, the longitudinal bar being arranged to extend longitudinally in the socket.

5. The cleaning arrangement of claim 1, wherein the cleaning member is arranged to be capable of providing contact with at least one segment of at least one support surface provided on at least one radially projecting member of the rotatable member.

6. The cleaning arrangement of claim 1, further comprising a lever mechanism arranged to cooperate with the pivot mechanism to pivotally move the cleaning member to its cleaning position when the weight of the vacuum cleaner acts on the lever mechanism.

7. The cleaning arrangement of claim 1, wherein the cleaning member is arranged to be moved from the resting position to the cleaning position by applying a pressing force to a push button provided on the socket.

8. The cleaning arrangement of claim 1, wherein the socket comprises a portion of a charging stand for charging of a vacuum cleaner associated with the vacuum cleaner nozzle.

9. The cleaning arrangement of claim 1, wherein the socket comprises a hand-held apparatus configured for use with a plurality of different vacuum cleaner nozzles.

10. The cleaning arrangement of claim 6, wherein the cleaning member is arranged to be moved from the resting position to the cleaning position by applying a pressing force to a push button provided on the socket.

11. A cleaning arrangement for a vacuum cleaner nozzle having a rotatable member therein, the cleaning arrangement comprising:

a charging stand configured to receive the vacuum cleaner nozzle;

a cleaning member located in a socket on the charging stand, the cleaning member being configured to clean articles from the rotatable member when the vacuum cleaner nozzle is mounted on the charging stand and the rotatable member is rotated; and a mechanism arranged to move the cleaning member between a resting position in which the cleaning member is lowered into the socket and a cleaning position in which the cleaning member is raised from the socket to cooperate with the rotatable member to remove the articles.

12. The cleaning arrangement of claim 11, wherein the cleaning member comprises a resilient sheet member capable of providing a resilient contact with the rotatable member.

13. The cleaning arrangement of claim 11, wherein the cleaning member comprises a resilient sheet member capable of providing a resilient contact with the rotatable member.

14. The cleaning arrangement of claim 13, wherein the cleaning member comprises a longitudinal bar holding the resilient sheet member, the longitudinal bar being arranged to extend longitudinally in the socket.

15. The cleaning arrangement of claim 11, wherein the cleaning member is arranged to be capable of providing contact with at least one segment of at least one support surface provided on at least one radially projecting member of the rotatable member.

16. The cleaning arrangement of claim 11, further comprising a lever mechanism arranged to cooperate with the pivot mechanism to pivotally move the cleaning member to its cleaning position, and wherein the lever mechanism is operable by one or both of: an application of the weight of the vacuum cleaner on the lever mechanism, or application of a force by an operator.

17. The cleaning arrangement of claim 11, further comprising a mechanism arranged to selectively move the cleaning member between a resting position in which the cleaning member is prevented from cleaning articles from the rotatable member and an cleaning position in which the cleaning member is able to clean articles from the rotatable member.

* * * * *